US011015284B2

(12) United States Patent
Cacho

(10) Patent No.: US 11,015,284 B2
(45) Date of Patent: May 25, 2021

(54) SYSTEM FOR DRYING PERSONAL PROTECTIVE EQUIPMENT

(71) Applicant: Alex Ignacio Cacho, Crowley, TX (US)

(72) Inventor: Alex Ignacio Cacho, Crowley, TX (US)

( * ) Notice: Subject to any disclaimer, the term of this patent is extended or adjusted under 35 U.S.C. 154(b) by 55 days.

(21) Appl. No.: 16/597,225

(22) Filed: Oct. 9, 2019

(65) Prior Publication Data

US 2020/0109510 A1 Apr. 9, 2020

Related U.S. Application Data

(60) Provisional application No. 62/743,277, filed on Oct. 9, 2018.

(51) Int. Cl.

| | |
|---|---|
| ***D06F 59/02*** | (2006.01) |
| ***F26B 21/00*** | (2006.01) |
| ***F26B 9/00*** | (2006.01) |

(52) U.S. Cl.

CPC ..... *D06F 59/02* (2013.01); *F26B 21/006* (2013.01); *F26B 9/00* (2013.01)

(58) Field of Classification Search

CPC .. D06F 9/00; D06F 59/02; F26B 21/00; F26B 21/006; F26B 21/001; F26B 9/00; F26B 9/10

USPC ..... 34/104

See application file for complete search history.

(56) References Cited

U.S. PATENT DOCUMENTS

| | | | | |
|---|---|---|---|---|
| 1,769,882 A * | 7/1930 | Kelley | D06F 59/02 | 34/105 |
| 2,543,413 A * | 2/1951 | Koth | D06F 73/00 | 223/67 |
| 3,333,747 A * | 8/1967 | Glover, Jr. | D06F 73/00 | 223/70 |
| 5,412,928 A * | 5/1995 | Reithel | A47L 23/205 | 34/104 |

(Continued)

FOREIGN PATENT DOCUMENTS

| | | | |
|---|---|---|---|
| CA | 2763184 A1 * | 7/2012 | D06F 59/02 |
| DE | 644635 C * | 5/1937 | F26B 21/00 |

(Continued)

OTHER PUBLICATIONS

Brochure for Ram Air Gear Dryer from www.ramairgeardryer.com.

(Continued)

*Primary Examiner* — Stephen M Gravini
(74) *Attorney, Agent, or Firm* — James E. Walton

(57) ABSTRACT

A system for supporting and drying personal protective equipment includes a ducting frame assembly, ventilated equipment racks connected to the frame assembly, and valves between the equipment racks and the ducting frame assembly. The system is supported by a base assembly, bracing, or a combination of a base and braces. A blower forces air through the frame assembly and may heat the air and add disinfecting or deodorizing substances to the air flow. Valves may be opened to direct the forced air into equipment racks and through ventilation apertures or open- (Continued)

ings in the racks. Personal protective equipment may be disposed upon the equipment racks, so that air is ventilated out of the racks and onto and around protective equipment on the racks.

20 Claims, 13 Drawing Sheets

(56) References Cited

U.S. PATENT DOCUMENTS

| | | | | | |
|---|---|---|---|---|---|
| 5,592,750 | A * | 1/1997 | Eichten | D06F 59/02 | 223/70 |
| 5,713,137 | A * | 2/1998 | Fujita | D06F 58/14 | 34/106 |
| 5,819,433 | A * | 10/1998 | Crooks | A43D 3/1491 | 34/104 |
| 5,862,606 | A * | 1/1999 | Jannach | D06F 17/04 | 34/106 |
| 6,134,806 | A * | 10/2000 | Dhaemers | F26B 21/00 | 34/404 |
| 8,621,762 | B2 * | 1/2014 | Beckett | D06F 59/02 | 34/90 |
| 8,793,892 | B2 * | 8/2014 | McLoughlin | F26B 9/003 | 34/105 |
| 8,844,154 | B2 * | 9/2014 | McLoughlin | F26B 9/003 | 34/104 |
| 9,015,955 | B2 * | 4/2015 | Vezina | D06F 59/02 | 34/60 |
| 9,072,359 | B2 * | 7/2015 | Agoro | A45D 20/00 | |
| 9,366,478 | B2 * | 6/2016 | DiMenichi | F26B 9/003 | |
| 10,041,205 | B2 * | 8/2018 | McLoughlin | D06F 59/02 | |
| 10,197,332 | B2 * | 2/2019 | Hinkey | F26B 3/02 | |
| 10,295,258 | B2 * | 5/2019 | Durham | D06F 59/02 | |
| 10,689,793 | B2 * | 6/2020 | Glass | A47B 61/003 | |
| 10,718,565 | B2 * | 7/2020 | Hinkey | F26B 21/006 | |
| 2017/0292787 | A1 * | 10/2017 | Denton | F26B 21/008 | |
| 2018/0355547 | A1 * | 12/2018 | Tsai | D06F 58/10 | |
| 2019/0374838 | A1 * | 12/2019 | Allen | A47B 46/005 | |
| 2020/0032450 | A1 * | 1/2020 | Vega | D06F 59/02 | |
| 2020/0040504 | A1 * | 2/2020 | Rochford | D06F 58/263 | |
| 2020/0095723 | A1 * | 3/2020 | Hinkey | A47G 25/20 | |
| 2020/0109510 | A1 * | 4/2020 | Cacho | D06F 59/02 | |

FOREIGN PATENT DOCUMENTS

| | | | | |
|---|---|---|---|---|
| EP | 2476797 | A1 * | 7/2012 | D06F 59/02 |
| GB | 464817 | A * | 4/1937 | B29B 13/06 |
| WO | WO-9854392 | A1 * | 12/1998 | D06F 59/02 |
| WO | WO-2018218583 | A1 * | 12/2018 | D06F 59/02 |
| WO | WO-2018218586 | A1 * | 12/2018 | D06F 58/00 |

OTHER PUBLICATIONS

Product Catalog for Ram Air Gear Dryer from www.ramairgeardryer.com.

Brochure for Ram Air Gear Dryer Accessories from www.ramairgeardryer.com.

* cited by examiner

SYSTEM FOR DRYING PERSONAL PROTECTIVE EQUIPMENT

This application claims the benefit of U.S. Provisional Application No. 62/743,277, filed on 9 Oct. 2018, titled "System for Drying Personal Protective Equipment," which is incorporated by reference herein for all purposes.

BACKGROUND

1. Field of the Invention

The present invention relates generally to improvements in systems for drying personal protective equipment, and more specifically to systems for drying protective turnout gear worn by firefighters.

2. Description of Related Art

Personal protective equipment often gets wet for a variety of reasons and needs to be dried. Specifically, personal protective equipment gets wet whenever it is washed and may require a system specifically designed for protective equipment to be properly dried.

For example, firefighter turnout gear is washed by putting the gear into a bath and thoroughly soaking and rinsing the gear. After washing, the turnout gear is difficult to quickly and properly dry due to the bulk and design of the gear. As a result of ineffective drying, turnout gear may mildew or mold or otherwise be harmed, which decreases the effectiveness of the gear. Furthermore, because turnout gear may still be wet when it is next needed by a firefighter, firefighters are less likely to wash their turnout gear. Therefore a drying system specifically suited for drying protective equipment is needed.

Modern drying systems specifically for protective equipment are available but have certain shortcomings. To ensure that protective equipment is properly maintained and dried, thereby ensuring the integrity of the equipment, there is a constant need for improvement in functional aspects of such equipment drying systems.

BRIEF DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
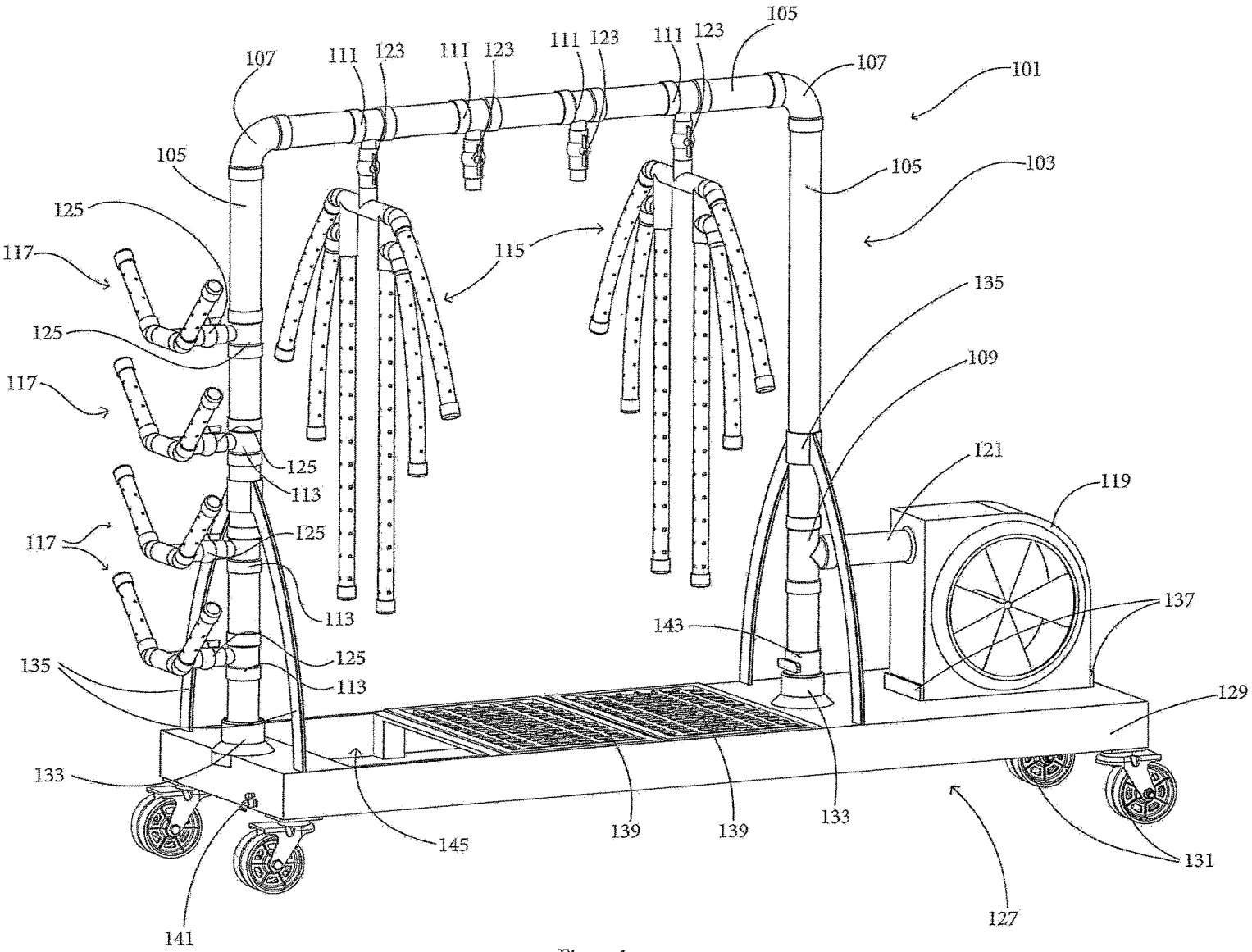
FIGS. 1 and 2 are perspective views of a protective-equipment drying system according to the preferred embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the drying system according to the present application are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
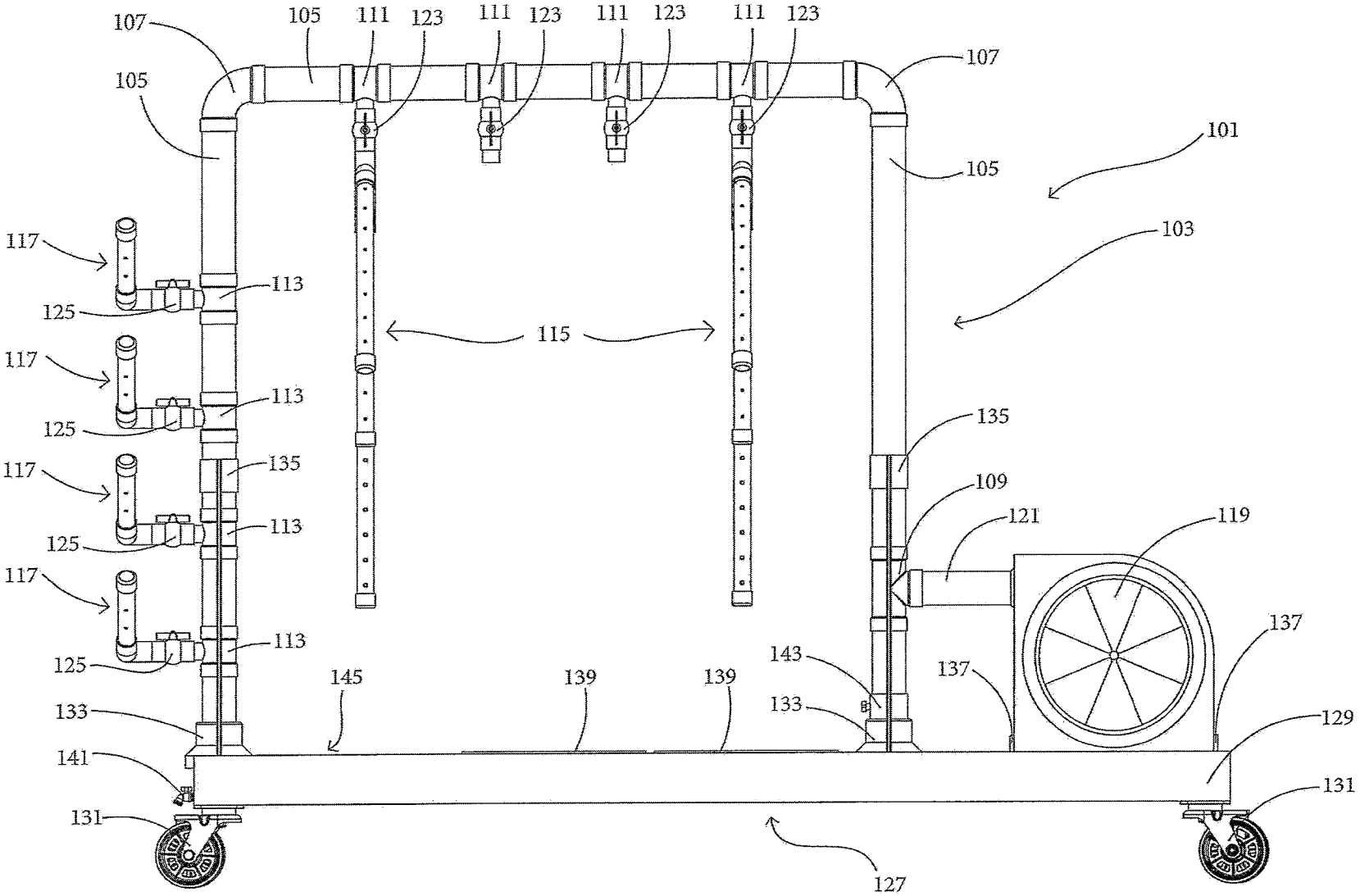

Referring now to FIGS. 1 and 2 in the drawings, a gear dryer 101 according to the preferred embodiment of the present application is depicted. Gear dryer 101 generally comprises a ducting frame assembly 103, at least one ventilated garment rack 115, at least one ventilated gear rack 117 or 501, a blower 119 connected to frame assembly 103 via a duct 121, at least one valve 123, at least one valve 125, and a rolling base assembly 127.

Frame assembly 103, according to the preferred embodiment of the present application, is made of several sub-components, including straight ducting frame segments 105, bent ducting frame segments 107, and ducting junctions 109, 111, 113. Frame segments 105 and 107, and junctions 109, 111, 113 direct air from blower 119 through frame assembly 103 and valves 123, 125 to ventilated garment racks 115 and ventilated gear racks 117, 501. Blower 119 is connected to frame assembly 103 through junction 109, valves 123 are connected at junctions 111, and valves 125 are connected at junctions 113. The sub-components of frame assembly 103 are preferably made of durable and corrosion-resistant materials, such as stainless steel, aluminum, polymer, or composites. Frame components may have surface treatments applied to increase their durability and corrosion resistance, such as painting, powder coating, or other treatments. In some embodiments, sub-components may be commonly available parts like PVC pipe lengths and fittings, or metal pipe or conduit and fittings.

The sub-components of frame assembly 103 preferably are attached to each other by some type of removable coupling method, such as flange couplings, threads formed in the sub-components, or dimensioning the sub-components such that they may be held together by friction. Due to the use of such sub-components and coupling methods, frame assembly 103 may be easily modified, reconfigured, or assembled to extend or reduce the length of frame assembly 103 and easily add or remove junction 111, 113 in the event that a user wishes to have more or fewer than the preferred number of ventilated garment racks 115 and ventilated gear racks 117.

FIGS. 1 and 2 show only two garment racks 115 attached to frame assembly 103, though four valves 123 and junctions 111 are seen. It should be understood that gear dryer 101, according to the preferred embodiment in the present application, preferably may have as few as one or as many as four garment racks installed. Four gear racks 117 are also shown, though preferably as few as one may be installed. It should be understood that alternative embodiments of gear dryer 101 may be configured to support more than four garment or gear racks.

Frame assembly 103 and other attached features are supported by and attached to a rolling base assembly 127 according to the preferred embodiment in the present application. Rolling base assembly 127 generally comprises a hollow base 129, casters 131, frame mounts 133, base-mounted bracing 135, a blower seat 137, at least one grate 139, a drain 141, a base valve 143, and at least one opening 145 in the top surface of hollow base 129. The features of rolling base assembly 127 are preferably made of durable and corrosion-resistant materials, such as stainless steel, aluminum, polymer, or composites. These features may have surface treatments applied to increase their durability and corrosion resistance, such as painting, powder coating, or other treatments. However, other material and material treatment choices may be made depending on the needs and demands of the desired application of gear dryer 101.

Hollow base 129 is generally a rectangular shape, having four sides, a top, and a bottom. Openings 145 are formed through the top surface of hollow base 129. According to the preferred embodiment in the present application, openings 145 allow any runoff or drips from protective equipment drying on ventilated garment racks 115 to fall into and be captured by hollow base 129. Openings 145 are covered by and support grates 139. Grates 139 catch debris or other objects that fall from racks 115 above and from equipment drying on racks 115.

According to the preferred embodiment in the present application, base assembly 127 contains a plurality of openings 145, and an equal number of grates 139 covering openings 145. As illustrated in FIGS. 1-6, grates 139 are single pieces that removably rest in openings 145. It should be understood though that grates 139 may each be multiple pieces and may be attached to base 129 or free from base 129. For example, base assembly 127 may have two-piece grates 139 which are hingeably attached to the top of hollow base 129, or may have grates 139 which are permanently attached to hollow base 129. Other gear dryer embodiments may have more of fewer openings and grates than the preferred embodiment. For example, a base may contain only one large opening and one large grate, or may have one large opening covered by multiple smaller grates, or may have multiple smaller openings that share one large grate.

According to the preferred embodiment in the present application, hollow base 129, as well as openings 145 and grates 139, extends at one end only to a first end of frame assembly 103, thereby not providing for the capture of any runoff or drips from gear racks 117, 501. In alternative embodiments, base 129, as well as openings 145 and grates 139, may extend beyond the first end of frame assembly 103 (not shown) in order to capture runoff or drips from equipment on gear racks 117, 501. Gear racks 117, 501 may also alternatively face inwards on frame assembly 103 (not shown) such that they are located above openings 145 and grates 139 when base 129 only extends on one end to the edge of frame assembly 103.

Figure 3:
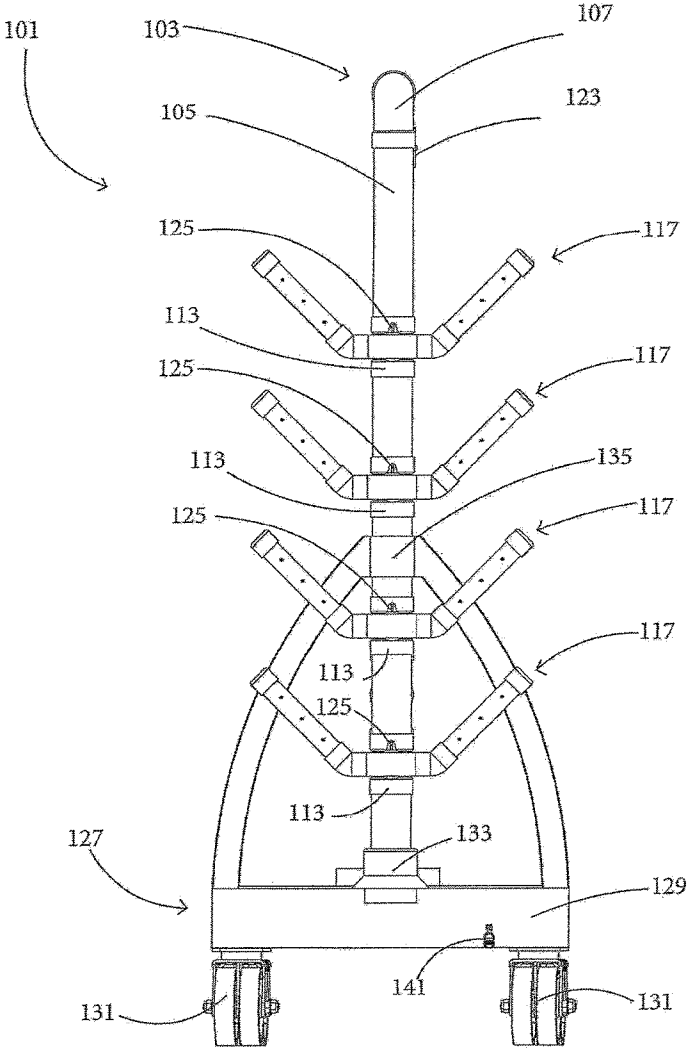
FIG. 3 is an end view showing certain features of the preferred embodiment shown in FIGS. 1 and 2.

Hollow base 129 has frame mounts 133 and base-mounted bracing 135 fixed on its top surface. Frame mounts 133 and bracing 135 support and retain frame assembly 103. As shown, frame mounts 133 are simple pockets into which the lower ends of frame assembly 103 fit, allowing frame assembly 103 to be easily removed from frame mounts 133 for maintenance or transport. It should be understood though that, according to the preferred embodiment or the present application, frame mounts 133 may be any form of frame mounting design, such as pockets, flanged couplings, or mounting points which allow frame assembly 103 to be bolted or otherwise attached to base assembly 127. Base-mounted bracing 135 preferably extends upwards from hollow base 129, and secures and orients frame assembly 103 as seen in FIGS. 1-3.

As illustrated, bracing 135 consists of multiple curved arms extending upwards and clamping around frame assembly 103, but it should be understood that bracing 135, according to the preferred embodiment in the present application, includes any form of bracing that extend between hollow base 129 and frame assembly 103. Other gear dryer embodiments may use wall-mounted bracing to secure a frame (see FIGS. 14, 15, 17, 19, 22).

Hollow base 129 has a blower seat 137 on its top surface. Blower seat 137 retains and orients blower 119. Blower seat 137, according to the preferred embodiment in the present application, may be a recess formed in the top of hollow base 129, or may be a pocket formed by bracing mounted on top of hollow base 129, or may be a combination thereof. In the preferred embodiment, air from blower 119, though primarily directed into frame assembly 103, may also be selectively directed into hollow base 129 through base valve 143. Base valve 143 may be part of a frame mount 133, or may be a separate component attached to and between frame mount 133 and frame assembly 103. Base valve 143 may be a ball valve or butterfly valve. Rolling base assembly 127 may include only one base valve 143 as shown in FIGS. 1 and 2, or may include base valves at all frame mounts 133 (not shown).

By directing air into hollow base 129, blower 119 and base valve 143 allow ventilation to help dry any fluids held in hollow base 129. When blower 119 is set at a higher flow rate, air may actually vent through hollow base 129 and up through grates 139 to provide additional ventilation to equipment hanging above on garment racks 115. Hollow base 129 may at times accumulate a greater volume of fluid than can effectively be dealt with by directing ventilation into base 129. As such, a drain 141 is fitted to hollow base 129. According to the preferred embodiment in the present application, drain 141 is a selectively-opened garden hose type faucet. Drain 141 may therefore empty fluids from base 129 directly onto the floor beneath gear dryer 101, or to empty fluids to a remote location with the use of a common garden hose. In other embodiments, drain 141 may be some other type of faucet or valve, or may be a simple opening and plug.

Rolling base assembly 127 contains a plurality of casters 131 attached to the bottom of hollow base 129. Casters 131 preferably are heavy-duty type casters designed for rolling on flat hard surfaces such as shop or garage floors and contain some form of locking mechanism so that the wheels of casters 131 may be selectively locked and unlocked. As such, gear dryer 101 may be easily moved and repositioned when necessary, and may be secured into a stationary position once in place. Other embodiments of a base assembly may contain all-terrain type casters (see FIGS. 20 and 21) for use in outdoor or rugged environments, or may not contain any casters and instead be permanently stationary (see FIGS. 15 and 17).

Gear dryer 101 preferably has a plurality of ventilated garment racks 115 and ventilated gear racks 117, 501, to which air is supplied by blower 119. According to the preferred embodiment in the present application, blower 119 may circulate simply circulate environmental air, or may be equipped with a heating element to supply heating ventilation through frame assembly 103 to ventilated racks 115 and 117, 501. Blower 119 may have at least one filter to clean particulates and contaminants from the environmental air. Blower 119 may be configured to also add disinfecting or odor fighting substances to the ventilation supplied to ventilated racks 115 and 117, 501. Alternative gear dryer embodiments may instead only use a blower to circulate air, and may place any combination of heating elements, filters, and substance dispersal implements anywhere within or on the frame assembly. Blower 119 preferably has control functions such as automatic timers, cycle alerts, temperature control settings, or selectable flow rate.

Blower 119 is connected to junction 109 of frame assembly 103 through blower duct 121. As illustrated, blower duct 121 is a rigid piece of straight tubing positioned perpendicular to frame assembly 103. Blower duct 121 though should be understood to include any kind of rigid or flexible ducting between blower 119 and frame assembly 103, and may be positioned and oriented at any angle and along any length. For example, in an alternative embodiment, a blower duct 1521 is illustrated as being a length of flexible ducting that allows a blower 1521 to be positioned at any angle and location relative to gear dryer 1501.

Figure 4:
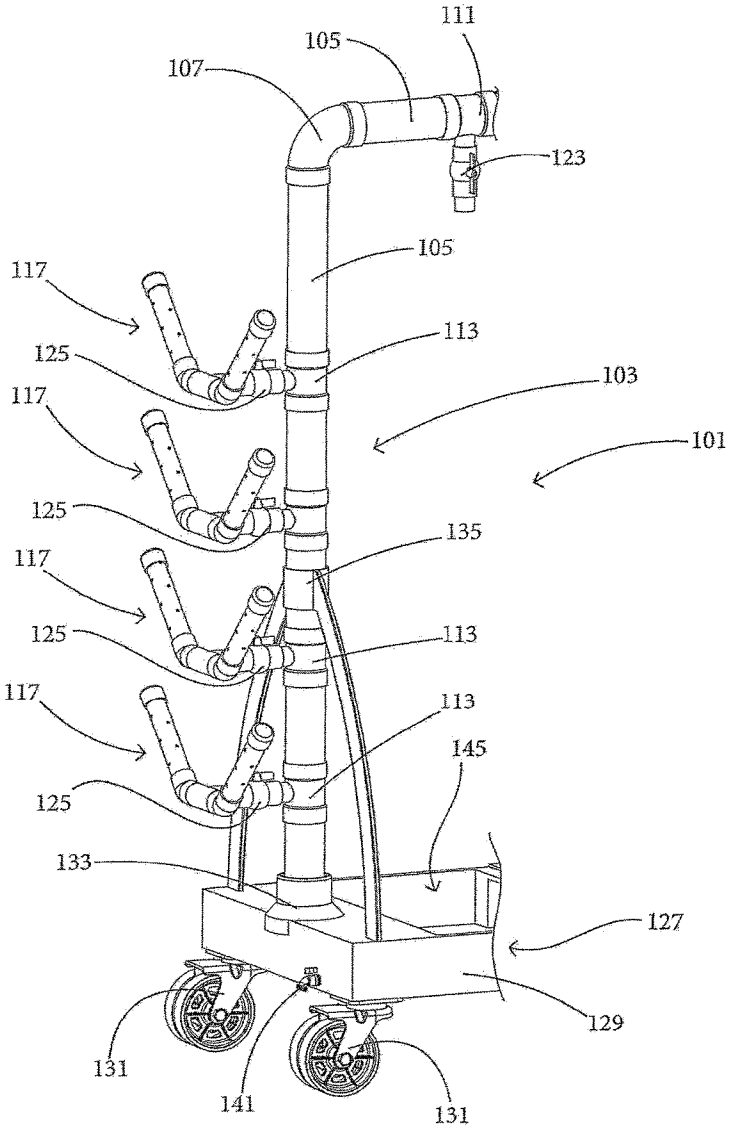
FIG. 4 is a perspective view of a portion of the preferred embodiment shown in FIGS. 1-3.

Gear dryer 101 has at least one, and preferably a plurality of, gear racks 117, 501 mounted along one end of frame assembly 103. Referring now to FIGS. 3 and 4 in the drawings, end portions of gear dryer 101 are shown with ventilated gear racks 117. Garment racks 115 are excluded from the illustration of gear dryer 101 for clarity so that gear racks 117 may be clearly seen. As shown in FIGS. 1-4, ventilated gear racks 117 are generally aligned with each other and are fixed primarily perpendicular to frame 103, and are positioned in a generally upright direction. Gear racks 117 are connected to junctions 113 through valves 125 by some removable coupling method, such as flange couplings, threads formed in portions of racks 117, 501, valves 125, and junctions 113, or simply being dimensioned to allow friction between the parts to hold them together. In other embodiments, racks 117 may be connected to junctions 113 permanently with methods such as the use of adhesive, screws, bolts, or welding.

Figure 6:
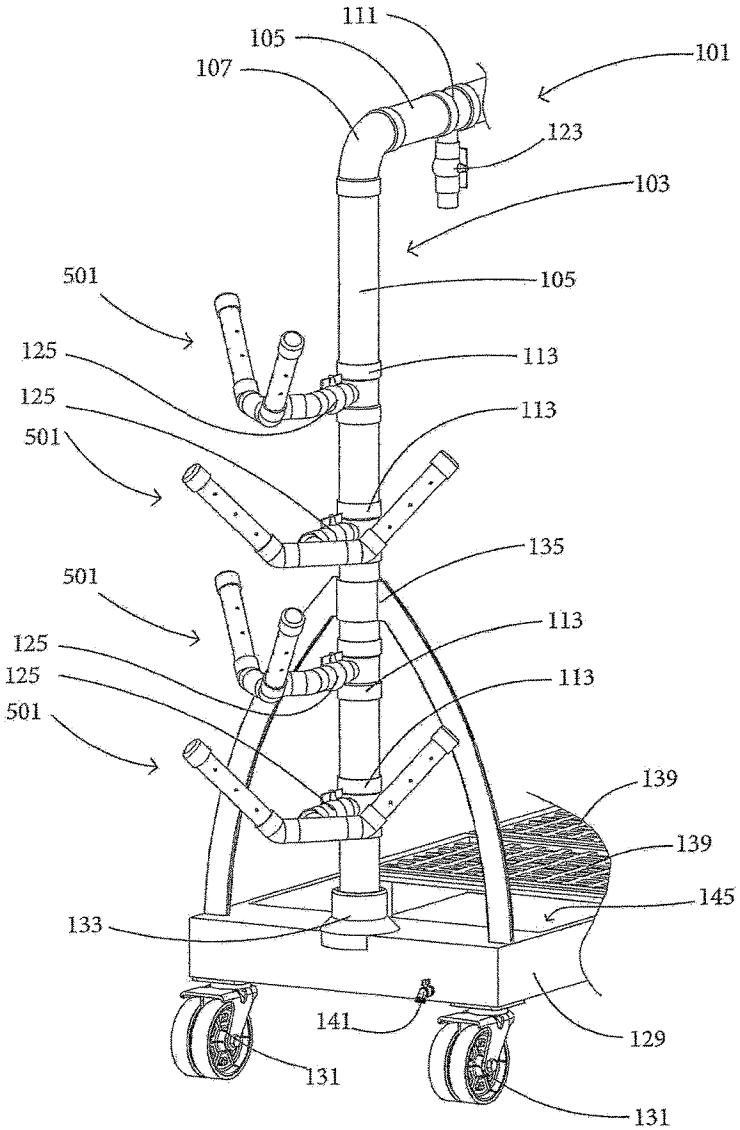
FIGS. 5 and 6 are views of certain features of the preferred embodiment not shown in FIGS. 1-4.
Figure 5:
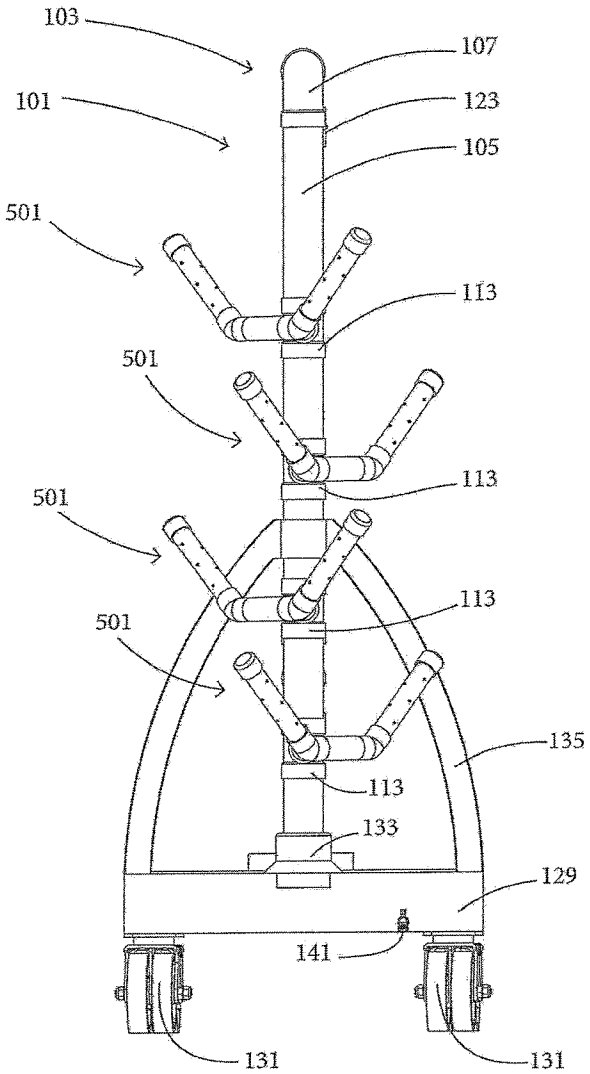

Referring now to FIGS. 5 and 6 in the drawings, gear racks 501 are shown mounted to junctions 113 through valves 125. Garment racks 115 are excluded from the illustration for clarity. Gear racks 501, unlike gear racks 117, are designed to be mounted at alternating or varying angles so that more space is available for protective equipment on the ends of each rack (see FIG. 6). As illustrated, racks 501 are oriented at roughly 45 degree angles away from frame 103 and in a generally upright position. It should be understood though that ventilated gear racks 501, according to the preferred embodiment in the present application, may be positioned at any angle horizontally about frame assembly 103 other than perpendicular, and may be positioned at any angle vertically other than directly upright such as extending forwards away from frame assembly 103 or extending rearwards toward frame assembly 103.

Ventilated gear racks 117, 501 are made of several subcomponents. Referring now to FIG. 13*a*, ventilated gear rack 117 is shown to generally comprise a ducting frame rack 1301, at least one rigid ventilated tube 1305, a plurality of apertures or vents 1307, and tube caps 1309. Apertures or vents 1307 may be circular as shown in FIG. 13*a*, or may have an ellipsoidal or other shape. For simplicity, hereinafter the term "vents" when used with respect to the preferred embodiment of, or alternative embodiments of, gear racks 115 shall include ventilation openings of any geometry in rigid tubes 1305.

Figure 13B:
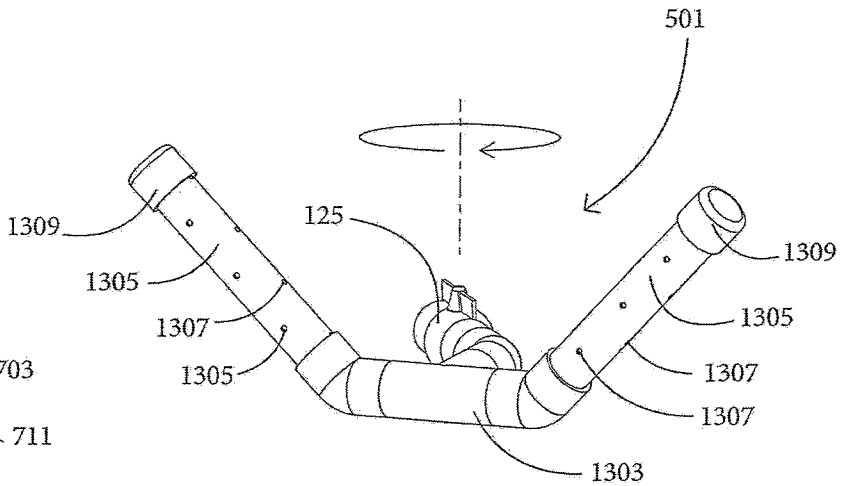
FIGS. 12, 13A, and 13B are enlarged views of valve features according to the preferred embodiment in the present application.
Figure 13A:
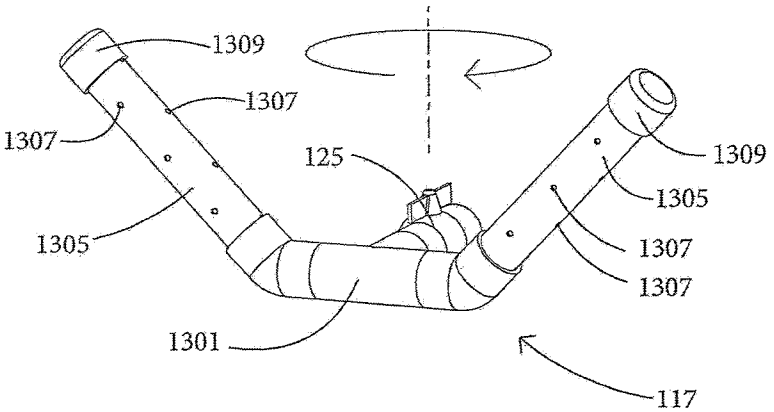

Referring now to FIG. 13*b*, ventilated gear rack 501 is shown to generally comprise a ducting frame rack 1303, at least one rigid ventilated tube 1305, a plurality of apertures or vents 1307, and tube caps 1309. Apertures or vents 1307 may be circular as shown in FIG. 13*b*, or may have an ellipsoidal or other shape. For simplicity, hereinafter the term "vents" when used with respect to the preferred embodiment of, or alternative embodiments of, gear racks 501 shall include ventilation openings of any geometry in rigid tubes 1305.

As illustrated in present application, other than in FIGS. 5 and 6, gear dryer 101 has four gear racks 117 all positioned along one end of frame assembly 103. However, according to the preferred embodiment in the present application, gear dryer 101 should be understood to contain at least one ventilated gear rack 117 or ventilated gear rack 501, and preferably contains four or more gear racks 117, 501 arranged in any combination and position a chooses.

Figure 7:
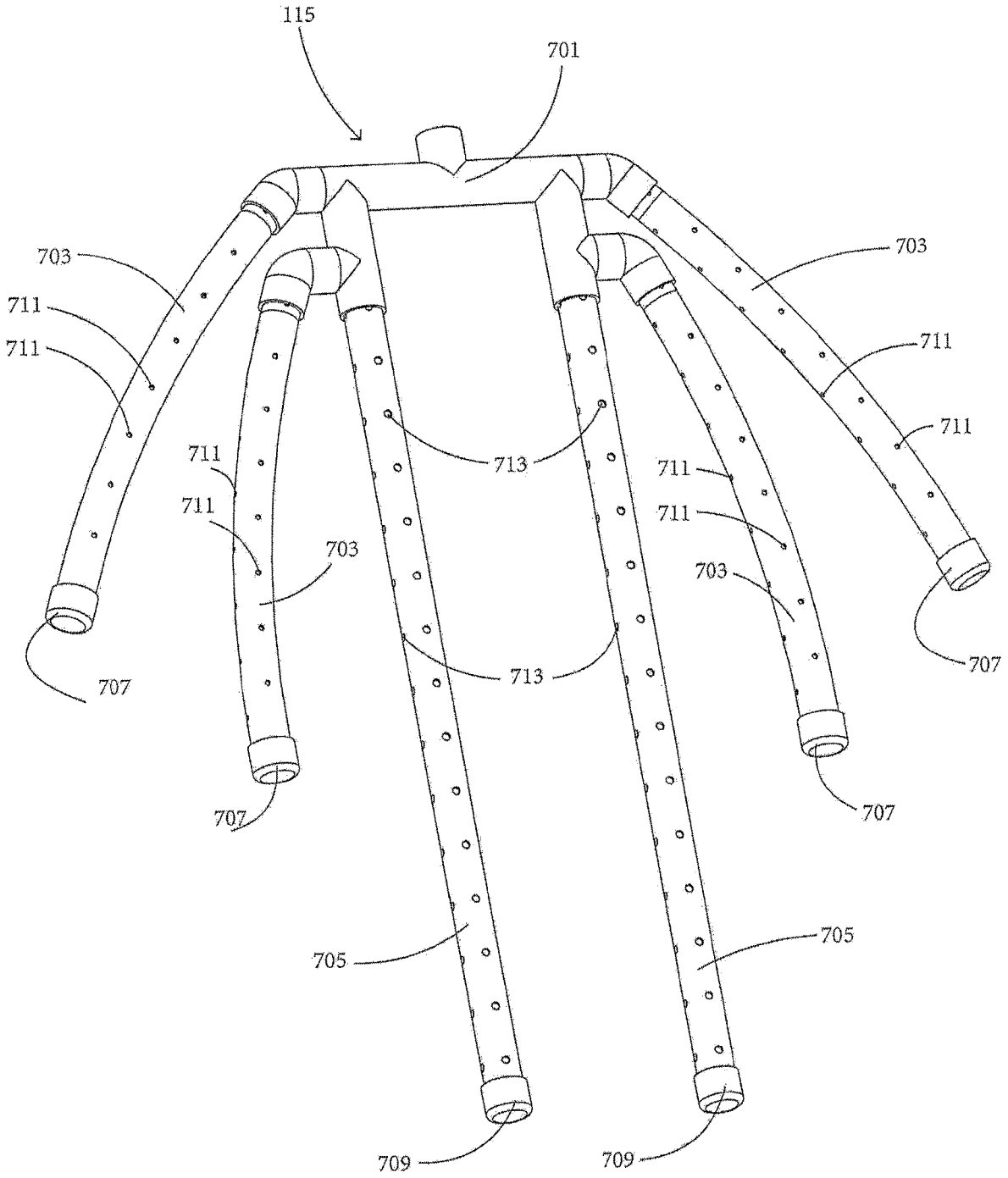
FIG. 7 is a perspective view of a garment-drying feature according to the preferred embodiment of the present application.
Figure 9:
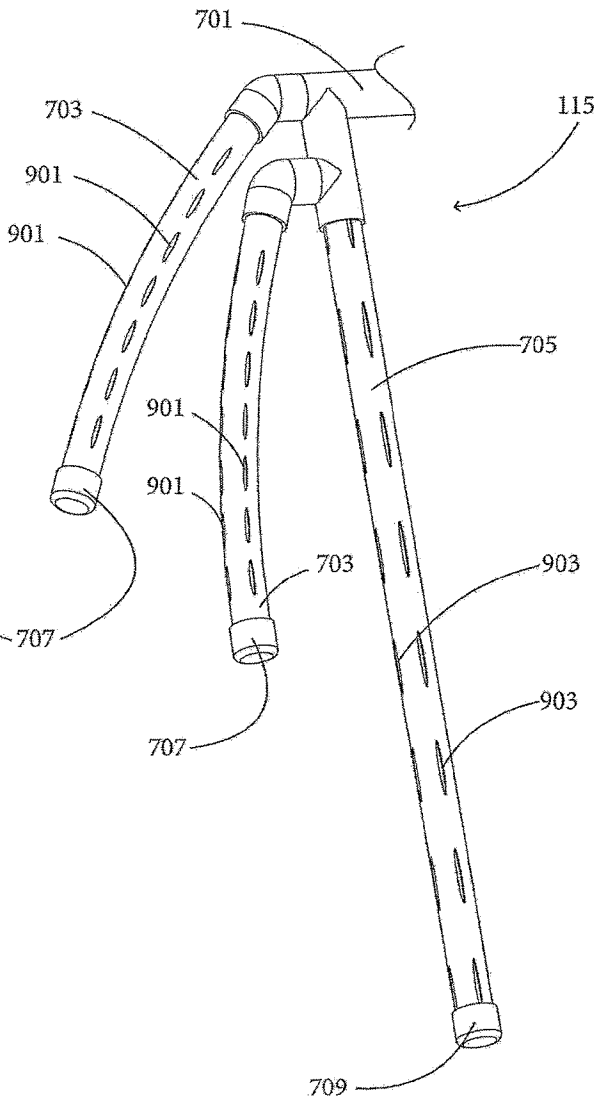
FIG. 9 is a partial view of the preferred embodiment of the garment-drying feature from FIGS. 7 and 8 containing vent features not otherwise shown in the present application.
Figure 8:
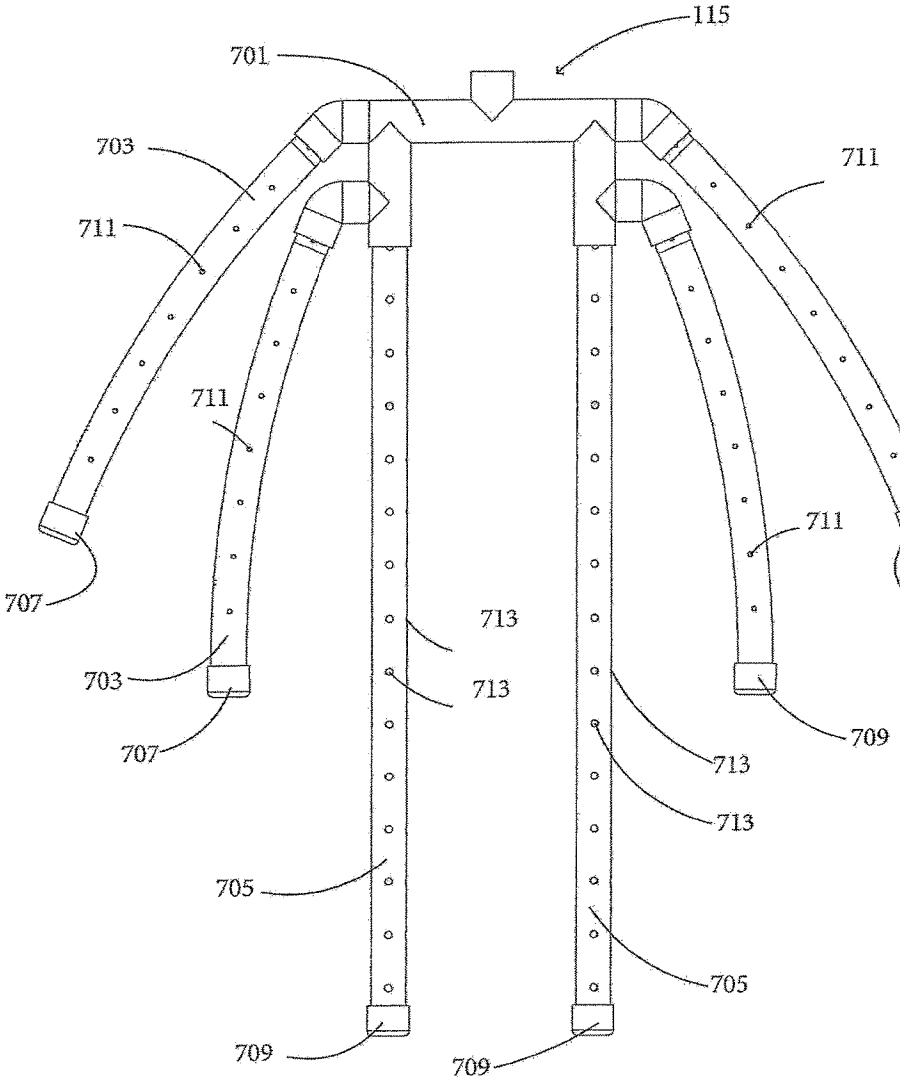
FIG. 8 is a front view of the garment-drying feature shown in FIG. 7.

Gear dryer 101 contains at least one ventilated garment rack 115. Referring now to FIGS. 7-9 in the drawings, garment rack 115 generally comprises a ducting garment rack frame 701, flexible ventilated tubes 703, rigid ventilated tubes 705, tube caps 707, 709, and apertures or vents 711, 713, 901, 903. Garment racks 115, according to the preferred embodiment in the present application, are mounted generally perpendicular to the length of frame assembly 103 along the top length of frame assembly 103

(see FIGS. 1 and 2). Garment racks 115 preferably are generally aligned with each other and are positioned in a generally upright direction. Garment racks 115 are connected to junctions 111 through valves 123 by some removable coupling method, such as flange couplings, or threads formed in portions of racks 115, valves 123, and junctions 111. In other embodiments, racks 115 may be connected to junctions 111 permanently with methods such as the use of adhesive, screws, bolts, or welding.

According to the preferred embodiment in the present application, garment rack 115 has two pairs of flexible ventilated tubes 703 and one pair of rigid ventilated tubes 705 (see FIGS. 7-9). Flexible tubes 703 preferably are made of some type of transparent and flexible polymer material. Rigid tubes 705, as well as garment rack frame 701 and caps 707, 709, are preferably made of rigid, durable and corrosion-resistant materials, such as stainless steel, aluminum, polymer, or composites. Rigid tubes 705, frame 701, and caps 707, 709 may have surface treatments applied to increase their durability and corrosion resistance, such as painting, powder coating, or other treatments.

Ventilated tubes 703 and 705 contain a plurality of circular apertures 711, 713 or ellipsoidal vents 901, 903. FIG. 7 shows garment rack 115 containing only circular apertures 711, 713, and FIG. 9 shows a partial view of garment rack 115 containing only ellipsoidal vents 901, 903. As illustrated in the present application other than in FIG. 9, garment rack 115 contains only circular apertures 711, 713 arranged symmetrically about their respective tubes. It should be understood though that garment rack 115 may contain any arrangement and combination of apertures 711, 713, vents 901, 903, and any otherwise-shaped ventilated openings in tubes 703, 705. For simplicity, all apertures 711, 713, vents 901, 903, and otherwise-shaped ventilated openings will hereinafter be referred to generically as "vents" with respect to any ventilated openings in garment racks 115.

Figure 11:
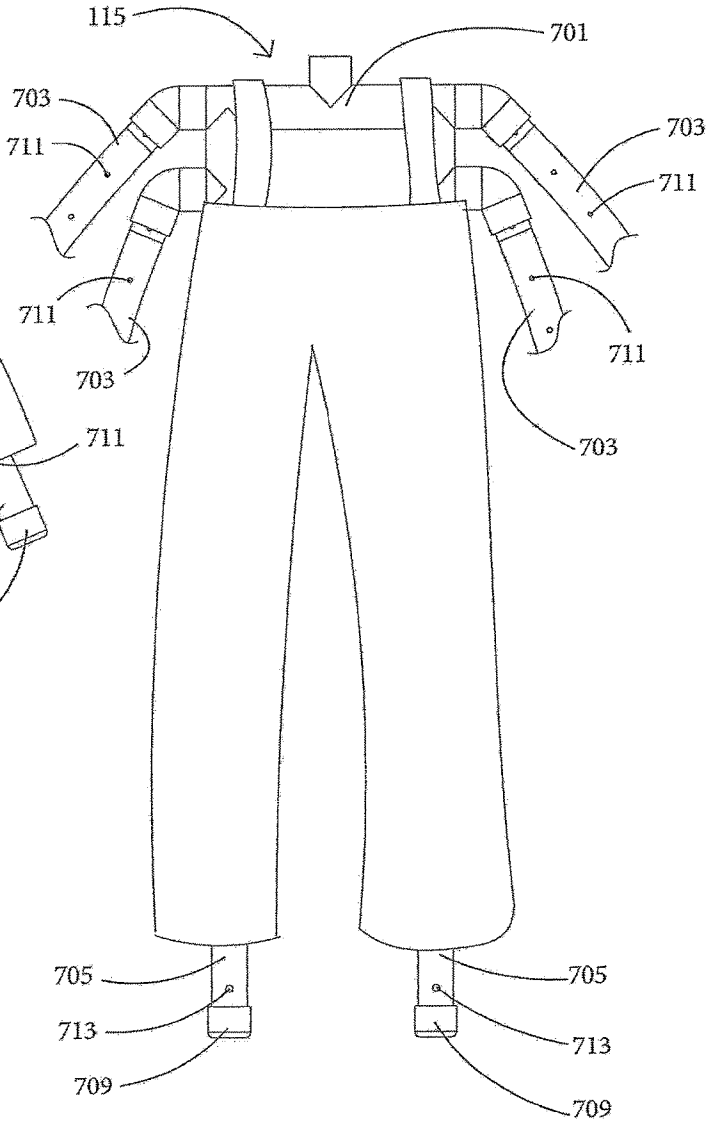
FIGS. 10 and 11 are perspective views illustrating preferred methods of use for the garment-drying feature shown in FIGS. 7 and 8.
Figure 10:
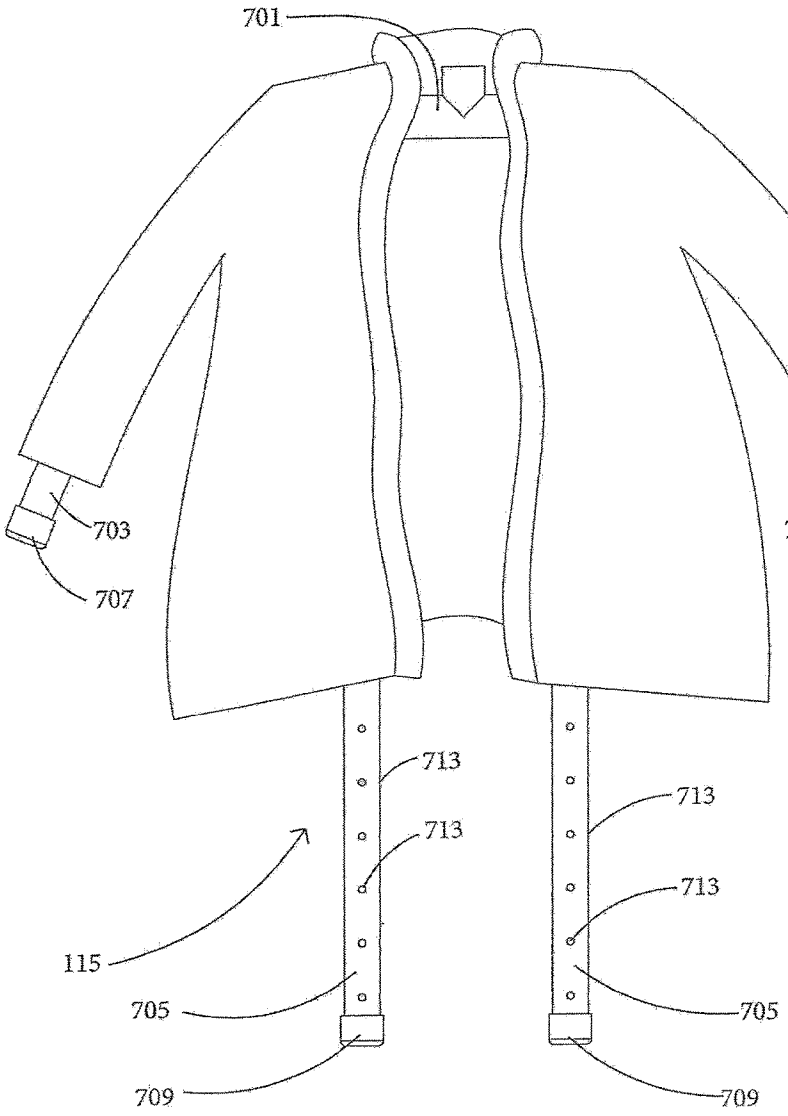

Garment rack 115 preferably is designed so that tubes 703 may be inserted into the sleeves of a coat or other garment and support and spread the waistband area of a coat, and so that rigid tubes 709 may extend through pant legs of any pants or overalls hung from frame 701. Referring now to FIGS. 10 and 11, the preferred method of use for garment racks 115 is depicted. FIG. 10 shows a coat with sleeves disposed around flexible ventilated tubes 703 and a torso area supported and spread apart by flexible tubes 703 within the coat. FIG. 11 shows a pair of pants with pant legs disposed around rigid ventilated tubes 705. Any pants, coveralls, or other garments with pant legs may be hung from ducting garment rack frame 701 with straps, ropes, cords or other suspension method, or any combination thereof. As shown in FIG. 11, the pants are suspended from ducting frame 701 via suspenders which are part of the pants.

In other embodiments of gear dryers, garment racks may be configured in a variety of ways not shown, and may use any arrangements and combinations of rigid ventilated tubes and flexible ventilated tubes. Other gear dryer embodiments may use any number of and combination of various garment rack embodiments arranged and oriented in any way.

Figure 12:
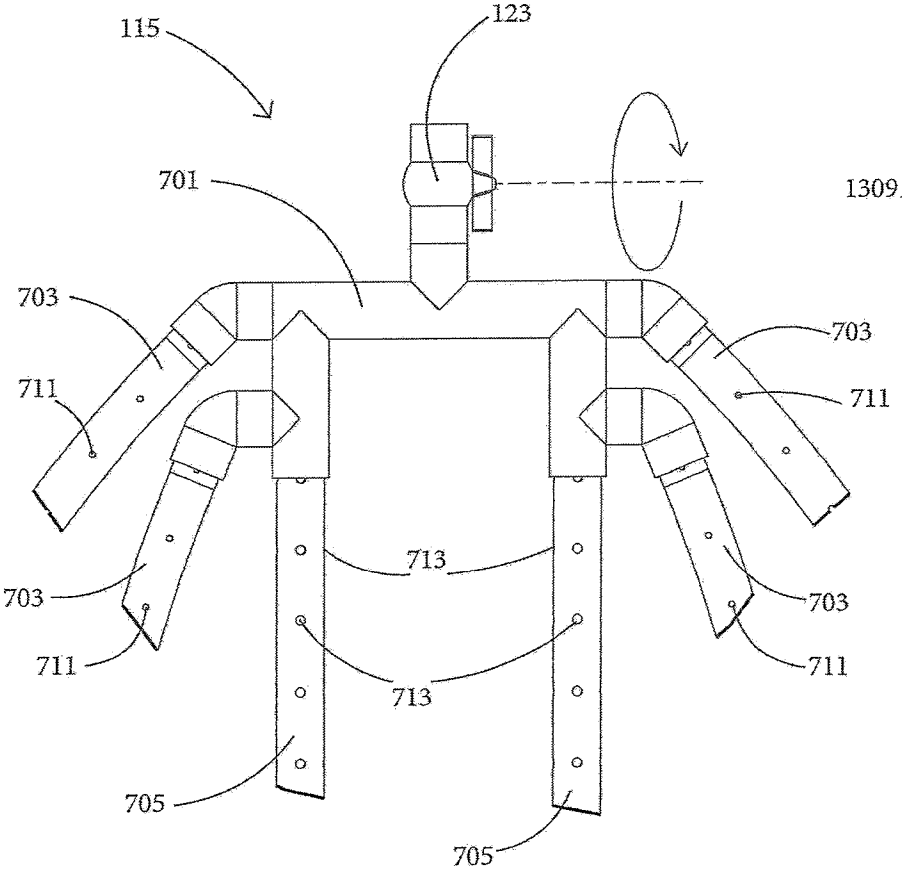

A benefit of the preferred gear dryer 101 embodiment according to the present application is that each ventilated garment rack 115 and ventilated gear rack 117 has its own corresponding valve 123, 125, respectively. Valves 123 and 125 preferably are ball valves. Referring now to FIGS. 12 and 13, the orientation of valves 123 and 125 with respect to garment rack 115 and gear racks 117, 501, respectively, can be seen. Valve 123 is oriented such that the valve handle is generally in line with garment rack 115 and is generally perpendicular to the length of frame assembly 103 (see FIGS. 1, 2, and 12). Valve 125 is oriented such that the valve handle is generally in line with the length of frame assembly 103 and is oriented in a generally upright position. In other gear dryer embodiments, valves may be designed Valves 123 and 125 preferably are attached to racks 115, 117, 501 and junctions 111, 113 by some removable coupling method such as flange couplings or threads formed in portions of racks 115, 117, 501, valves 123, 125, and junctions 111, 113. Valves 125, junctions 113, and racks 117, 501 may also simply being dimensioned such that friction between the parts holds them together. In other embodiments, valves 123, 125 may be connected to racks 115, 117 and junctions 111, 113 permanently with methods such as the use of adhesive, screws, bolts, or welding. Alternatively, the valves may actually be an integral part of a frame assembly (see FIG. 22).

Figure 14:
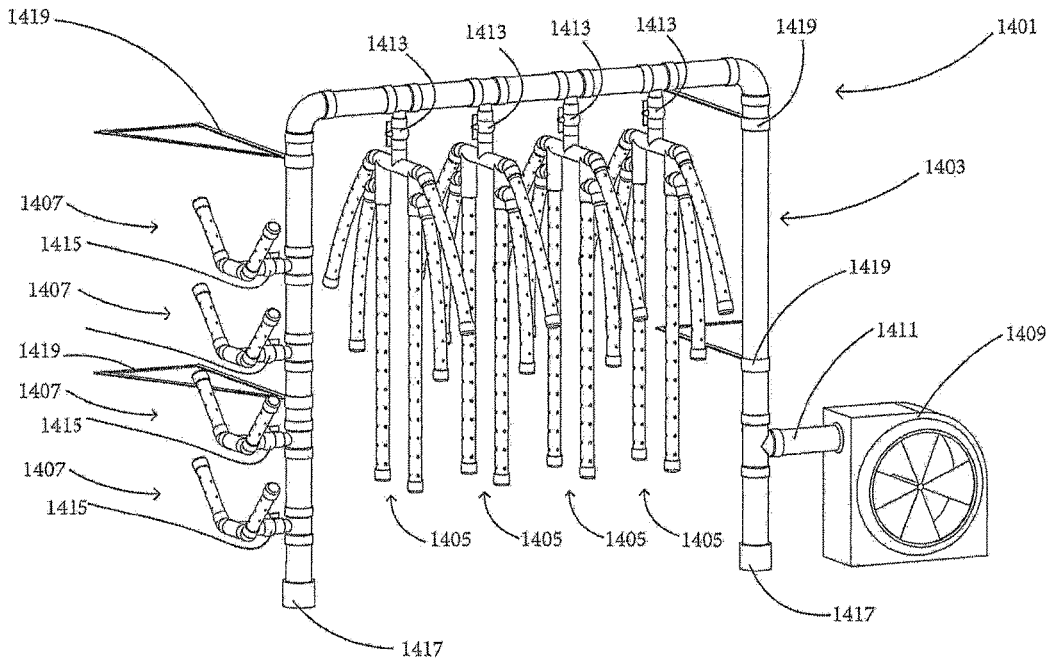
FIG. 14 is a perspective view of an alternative embodiment of a protective-equipment drying system according to the present application.

The preferred embodiment of a gear dryer 101 has been described. However, several alternative embodiments exist. Referring now to FIG. 14, an alternative gear dryer 1401 is shown. Gear dryer 1401 generally comprises a ducting frame assembly 1403, at least one ventilated garment rack 1405, at least one ventilated gear rack 1407, a blower 1409 connected to frame assembly 1403 via a duct 1411, at least one valve 1413, at least one valve 1415, base caps 1417, and at least one wall brace 1419. Frame assembly 1403 is similar in form and function to frame assembly 103 in the preferred embodiment.

Ventilated racks 1405 and 1407 are similar in form and function to preferred embodiment racks 115 and 117, respectively. Blower 1409 and blower duct 1411 are similar in form and function to preferred embodiment blower 119 and blower duct 121, respectively. Valves 1413 and 1415 are similar in form and function to preferred embodiment valves 123 and 125, respectively.

Gear dryer 1401, rather than using a base assembly, uses a combination of base caps 1417 and wall braces 1419 to support and retain frame assembly 1403. Base caps 1417 may be simple pockets into which the ends of frame assembly 1403 fit, or may be shaped caps, such as flanged caps with bolt holes, that allow gear dryer 1401 to be fixed directly to a surface directly beneath base caps 1417. As illustrated, base caps 1417 and simple pockets. As illustrated in FIG. 14, gear dryer 1401 uses four wall braces 1419 attached at upper and lower portions of each end of frame assembly 1403 to keep gear dryer 1401 fixed and upright. It should be understood though that gear dryer 1401 actually may use as few as one wall brace 1419 or more than the four shown to secure gear dryer 1401.

Figure 15:
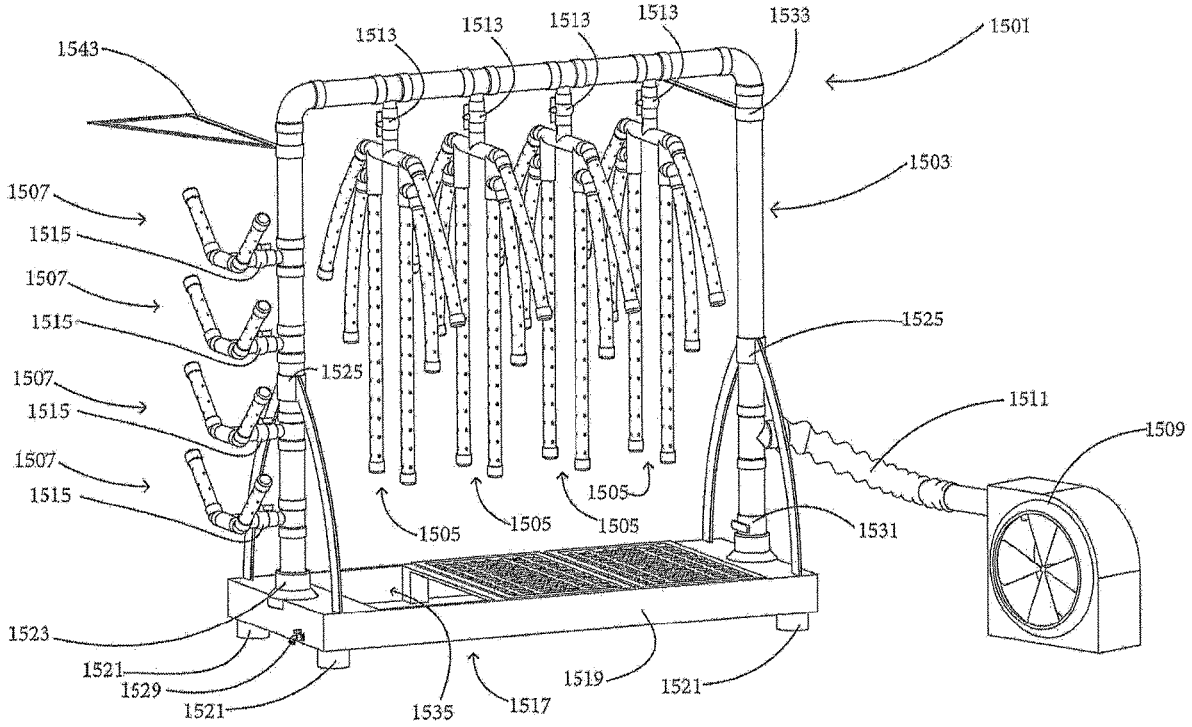
FIG. 15 is a perspective view of an alternative embodiment of a protective-equipment drying system according to the present application.

Referring now to FIG. 15, an alternative gear dryer 1501 is shown. Gear dryer 1501 generally comprises a ducting frame assembly 1503, at least one ventilated garment rack 1505, at least one ventilated gear rack 1507, a blower 1509 connected to frame assembly 1503 via a duct 1511, at least one valve 1513, at least one valve 1515, a stationary base assembly 1517, and wall braces 1533. Frame assembly 1503 is similar in form and function to frame assembly 103 in the preferred embodiment.

Ventilated racks 1505 and 1507 are similar in form and function to preferred embodiment racks 115 and 117, respectively. Blower 1509 is similar in form and function to preferred embodiment blower 119. Valves 1513 and 1515 are similar in form and function to preferred embodiment valves 123 and 125, respectively. Wall braces 1533 are similar in form and function to wall braces 1419 from the embodiment shown in FIG. 14, except that gear dryer 1501 does not use wall braces at a lower extend of frame assembly 1503 since it is secured by base assembly 1517.

Gear dryer 1501 is supported and secured by stationary base assembly 1517. Base assembly 1517 generally comprises a hollow base 1519, base pads 1521, frame mounts 1523, base-mounted bracing 1525, at least one grate 1527, a drain 1529, a base valve 1531, and at least one opening 1535 in the top of hollow base 1529. Hollow base 1529 is similar in form and function to preferred embodiment hollow base 129. Frame mounts 1523 are similar in form and function to frame mounts 133 from the preferred embodiment. Base-mounted bracing 1525 is similar in form and function to bracing 135 from the preferred embodiment. Grates 1527 are similar in form and function to grates 139 from the preferred embodiment. Drain 1529 is similar in form and function to drain 141 from the preferred embodiment. Base valve 1531 is similar in form and function to base valve 143 from the preferred embodiment. Opening 1535 is similar in form and function to opening 145 from the preferred embodiment.

Unlike the preferred embodiment, the base assembly for gear dryer 1501 does not have casters or wheels of any sort. Instead, base assembly 1517 is stationary and has base pads 1521 mounted underneath it to support gear dryer 1501. Unlike the preferred embodiment, base assembly 1517 does not have a blower seat. Instead, blower 1509 is separate from base assembly 1517 and is connected to frame assembly 1503 with a flexible and extendable blower duct 1511.

Figure 16:
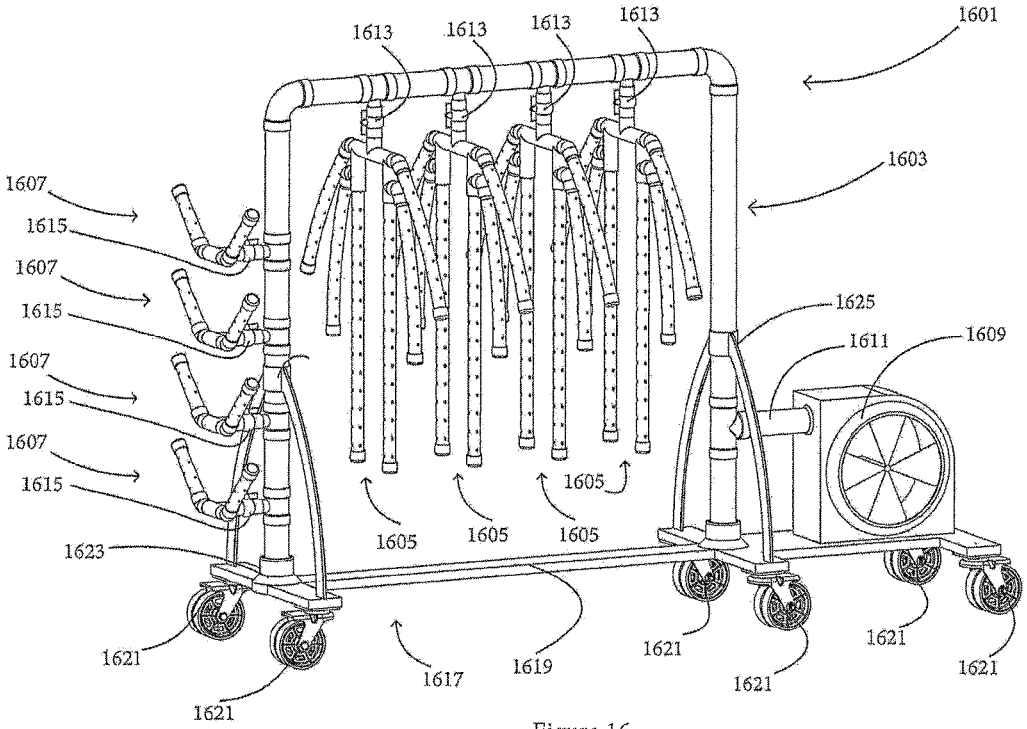
FIG. 16 is a perspective view of an alternative embodiment of a protective-equipment drying system according to the present application.

Referring now to FIG. 16, an alternative gear dryer 1601 is shown. Gear dryer 1601 generally comprises a ducting frame assembly 1603, at least one ventilated garment rack 1605, at least one ventilated gear rack 1607, a blower 1609 connected to frame assembly 1603 via a duct 1611, at least one valve 1613, at least one valve 1615, and a rolling base assembly 1617. Frame assembly 1603 is similar in form and function to frame assembly 103 in the preferred embodiment.

Ventilated racks 1605 and 1607 are similar in form and function to preferred embodiment racks 115 and 117, respectively. Blower 1609 and blower duct 1611 are similar in form and function to preferred embodiment blower 119 and blower duct 121, respectively. Valves 1603 and 1605 are similar in form and function to preferred embodiment valves 123 and 125, respectively.

Gear dryer 1601 is supported and secured by rolling base assembly 1617. Base assembly 1617 generally comprises a solid base 1619, casters 1621, frame mounts 1623, base-mounted bracing 1625, and a blower seat 1627. Casters 1621 are similar in form and function to casters 131 from the preferred embodiment, although there are preferably six casters in base assembly 1617. Frame mounts 1623 are similar in form and function to frame mounts 133 from the preferred embodiment. Base-mounted bracing 1625 is similar in form and function to bracing 135 from the preferred embodiment. Blower seat 1627 is similar in form and function to blower seat 137 from the preferred embodiment.

Unlike hollow base 129 from the preferred embodiment, which can capture and hold runoff fluids and drips, base 1619 is solid structure. Base 1619 provides a rolling support platform for gear dryer 1601, but is not designed to capture fluids falling from protective equipment drying on gear dryer 1601.

Figure 17:
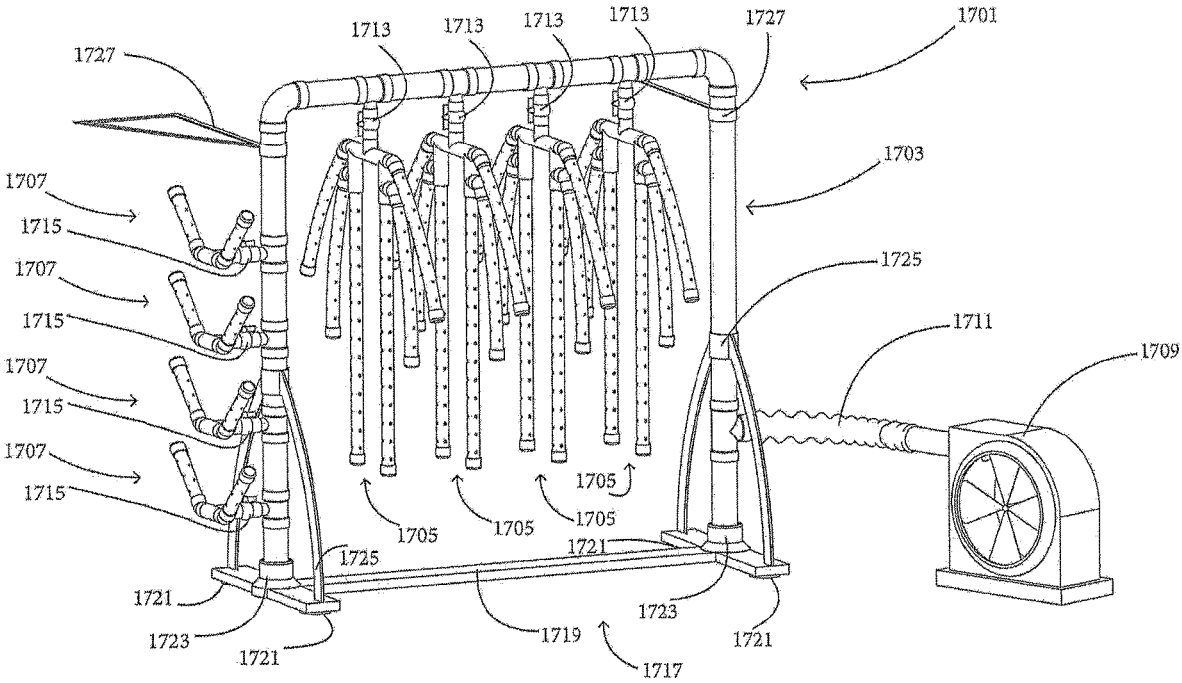
FIG. 17 is a perspective view of an alternative embodiment of a protective-equipment drying system according to the present application.
Figure 19:
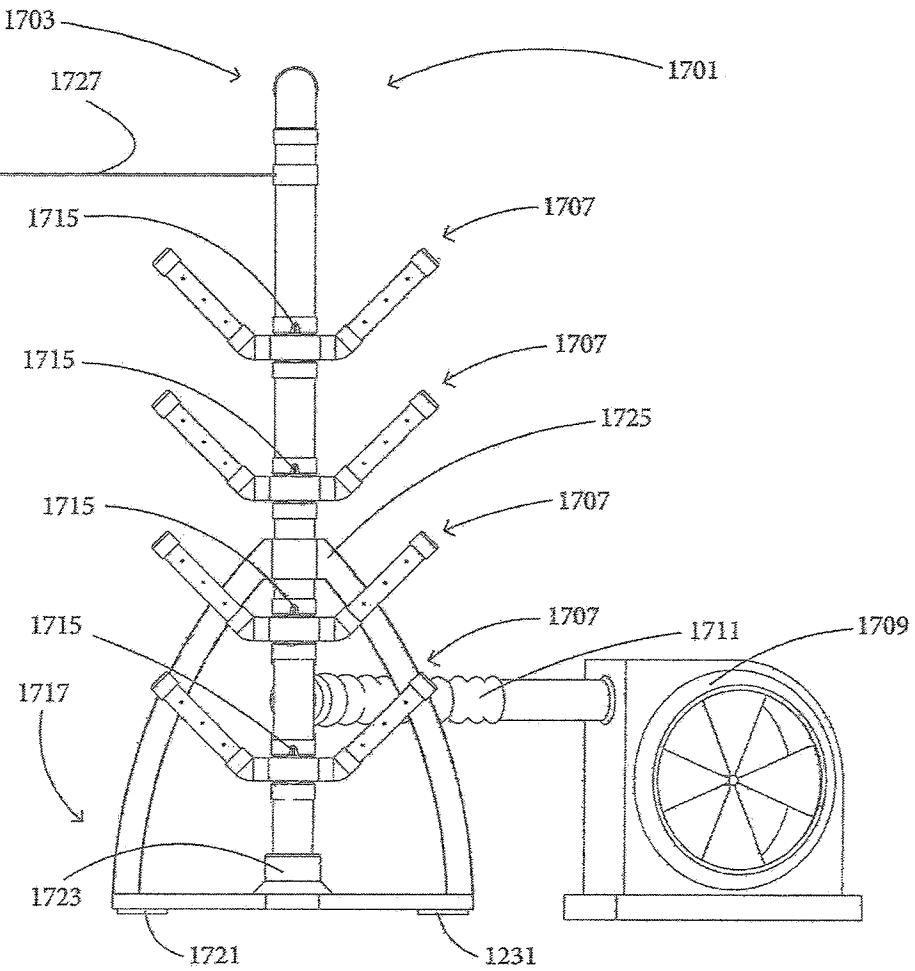
FIG. 19 is an end view of the drying system embodiment shown in FIG. 17.
Figure 18:
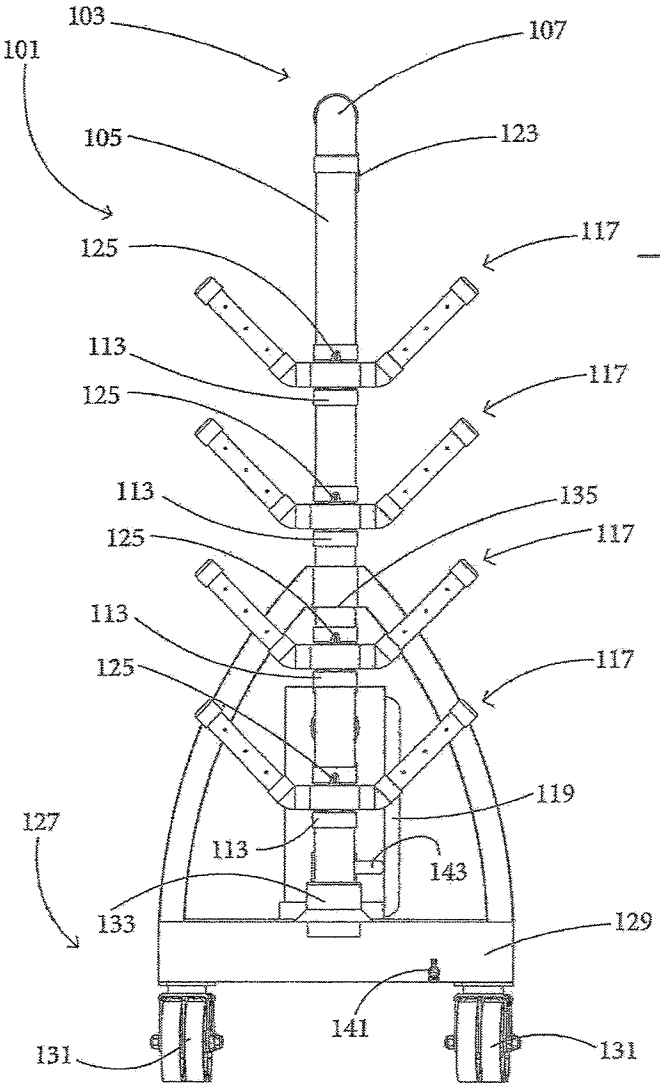
FIG. 18 is an end view of the drying system embodiment shown in FIG. 14.

Referring now to FIG. 17, an alternative gear dryer 1701 is shown. Gear dryer 1701 generally comprises a ducting frame assembly 1703, at least one ventilated garment rack 1705, at least one ventilated gear rack 1707, a blower 1709 connected to frame assembly 1703 via a duct 1711, at least one valve 1713, at least one valve 1715, a rolling base assembly 1717, and wall braces 1727. Frame assembly 1703 is similar in form and function to frame assembly 103 in the preferred embodiment.

Ventilated racks 1705 and 1707 are similar in form and function to preferred embodiment racks 115 and 117, respectively. Blower 1709 and blower duct 1711 are similar in form and function to preferred embodiment blower 119 and blower duct 121, respectively. Valves 1713 and 1715 are similar in form and function to preferred embodiment valves 123 and 125, respectively. Wall braces 1727 are similar in form and function to wall braces 1429 from the embodiment shown in FIG. 14, except that gear dryer 1701 does not use wall braces at a lower extend of frame assembly 1703 since it is secured by base assembly 1717.

Gear dryer 1701 is supported and secured by stationary base assembly 1717. Base assembly 1717 generally comprises a solid base 1719, base pads 1721, frame mounts 1723, and base-mounted bracing 1725. Frame mounts 1723 are similar in form and function to frame mounts 133 from the preferred embodiment. Base-mounted bracing 1725 is similar in form and function to bracing 135 from the preferred embodiment.

Unlike hollow base 129 from the preferred embodiment, base 1719 is not designed to capture runoff fluids and drips, and is instead similar in form and function to base 1619. Unlike the preferred embodiment, the base assembly for gear dryer 1701 does not have casters or wheels of any sort. Instead, base assembly 1717 is stationary and has base pads 1721 mounted underneath it to support gear dryer 1701. Unlike the preferred embodiment, base assembly 1717 does not have a blower seat. Instead, blower 1709 is remote from base assembly 1717 and is connected to frame assembly 1703 with a flexible and extendable blower duct 1711.

Figure 21:
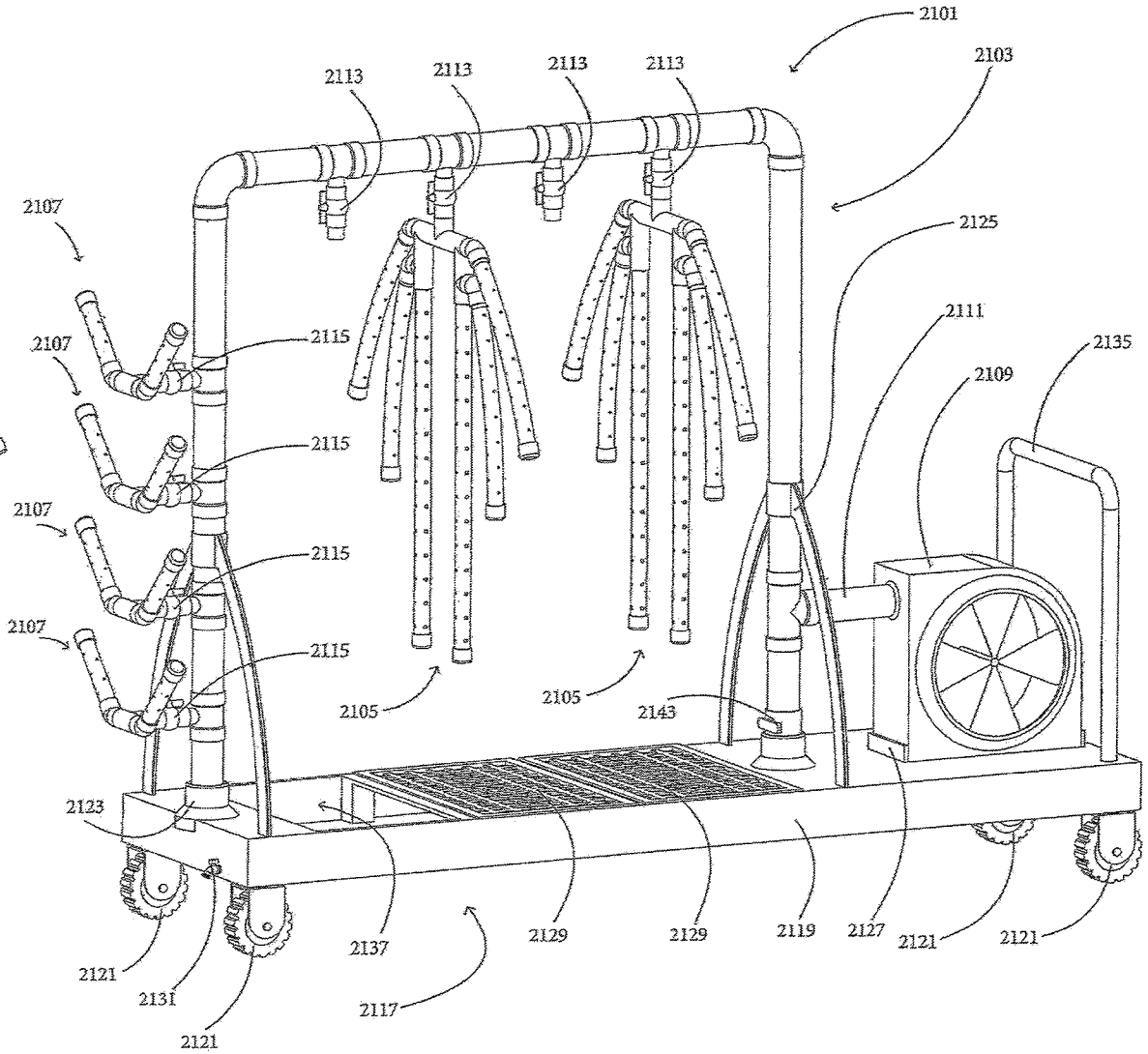
FIG. 21 is a perspective view of the drying system embodiment shown in FIG. 20.
Figure 20:
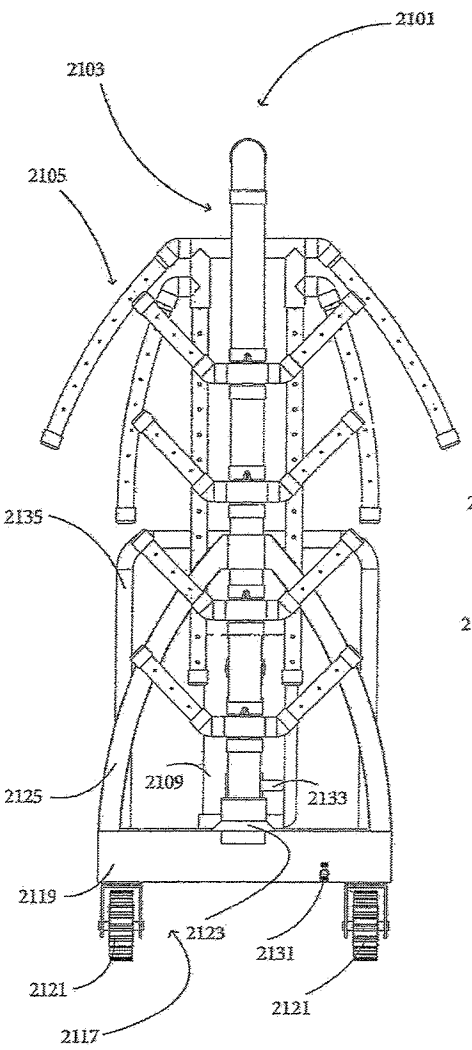
FIG. 20 is an end view of an alternative embodiment of a protective-equipment drying system according to the present application.

Referring now to FIGS. 20 and 21, an alternative gear dryer 2101 is shown. Gear dryer 2101 generally comprises a ducting frame assembly 2103, at least one ventilated garment rack 2105, at least one ventilated gear rack 2107, a blower 2109 connected to frame assembly 2103 via a duct 2111, at least one valve 2113, at least one valve 2115, and a rolling base assembly 2117. Frame assembly 2103 is similar in form and function to frame assembly 103 in the preferred embodiment.

Ventilated racks 2105 and 2107 are similar in form and function to preferred embodiment racks 115 and 117, respectively. Blower 2109 is similar in form and function to preferred embodiment blower 119. Valves 2113 and 2115 are similar in form and function to preferred embodiment valves 123 and 125, respectively.

Gear dryer 2101 is supported and secured by stationary base assembly 2117. Base assembly 2117 generally comprises a hollow base 2119, all-terrain casters 2121, frame mounts 2123, base-mounted bracing 2125, a blower seat 2127, at least one grate 2129, a drain 2131, a base valve 2133, a handle 2135, and at least one opening 2137 in the top of hollow base 2119. Hollow base 2119 is similar in form and function to preferred embodiment hollow base 129. Frame mounts 2123 are similar in form and function to frame mounts 133 from the preferred embodiment. Base-mounted bracing 2125 is similar in form and function to bracing 135 from the preferred embodiment. Blower seat 2127 is similar in form and function to blower seat 137 from the preferred embodiment. Grates 2129 are similar in form and function to grates 139 from the preferred embodiment. Drain 2131 is similar in form and function to drain 141 from the preferred embodiment. Base valve 2133 is similar in form and function to base valve 143 from the preferred embodiment. Opening 2137 is similar in form and function to opening 145 from the preferred embodiment.

Unlike the preferred embodiment, base assembly 2117 has all-terrain casters 2121 well-suited for rough or outdoor terrain, as opposed to the casters 131 from the preferred embodiment suited for hard surfaces like shop or garage floors. All-terrain casters 2121 could function on garage or shop floors, but are better suited for rugged environments. For example, gear dryer 2101 could be used by first responders in the field, such as firefighters stationed at base-camps near wildfires, or first responders and disaster relief workers working in urban areas after disasters such as hurricanes or tornadoes. Toward such an end, gear dryer 2101 also has a handle 2135 attached to base 2119 to provide a means for physically moving gear dryer 2101 about a rugged environment. In addition, gear dryer 2101 may include a power supply, such as a battery, a rechargeable battery, a solar powered recharging system, or other types of power sources for providing power to blower 2109. The power source may integrated with gear dryer 2109, or may be a separate component from gear dryer 2109. Other gear dryer embodiments with casters suited for hard floor surfaces could also have the same or similar handle so that those gear dryers could be easily moved about a garage or shop space.

Figure 22:
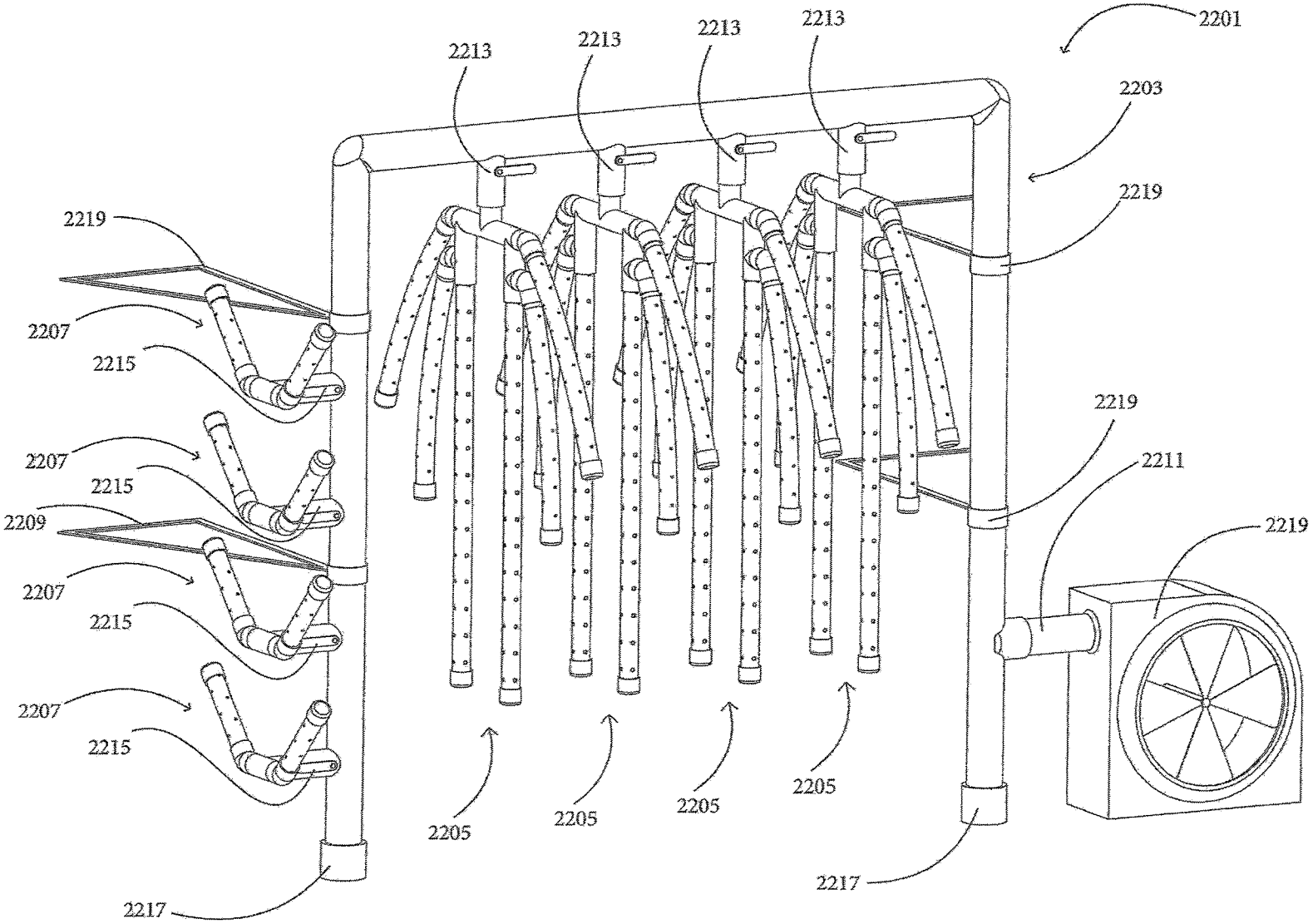
FIG. 22 is a perspective view of an alternative embodiment of a protective-equipment drying system according to the present application.

Referring now to FIG. 22, an alternative gear dryer 2201 is shown. Gear dryer 2201 generally comprises a ducting frame assembly 2203, at least one ventilated garment rack 2205, at least one ventilated gear rack 2207, a blower 2209 connected to frame assembly 2203 via a blower duct 2211, at least one valve 2213, at least one valve 2215, base caps 2217, and at least one wall brace 2219.

Ventilated racks 2205 and 2207 are similar in form and function to preferred embodiment racks 115 and 117, respectively. Blower 2209 and blower duct 2211 are similar in form and function to preferred embodiment blower 119 and blower duct 121, respectively.

Frame assembly 2203 is unlike frame assembly 103 from the preferred embodiment. Frame assembly 2203 does have straight and bent ducting frame segments and ducting junctions. However, unlike frame assembly 103, frame assembly 2203 does not use sub-components fashioned together into a frame assembly. Instead, frame assembly 2203 is a single solid and continuous ducting frame. Frame assembly 2203 further contains valves 2213 and 2215. Valves 2213 and 2215 function similarly to valves 123 and 125 from the preferred embodiment, but unlike the preferred embodiment, valves 2213 and 2215 are integral portions of frame assembly 2203. Garment racks 2205 and gear racks 2207 may be attached to valves 2213 and 2215 in a manner similar to racks 115 and 117 from the preferred embodiment, but valves 2213 and 2215 themselves are integral to frame assembly 2203.

Gear dryer 2201, rather than using a base assembly, uses a combination of base caps 2217 and wall braces 2219 to support and retain frame assembly 2203. Base caps 2217 may be simple pockets into which the ends of frame assembly 2203 fit, or may be shaped caps, such as flanged caps with bolt holes, that allow gear dryer 2201 to be fixed directly to a surface directly beneath base caps 2217. As illustrated, base caps 2217 are simple pockets. As illustrated in FIG. 22, gear dryer 2201 uses four wall braces attached at upper and lower portions of each end of frame assembly 2203 to keep gear dryer 2201 fixed and upright. It should be understood though that gear dryer 2201 actually may use as few as one wall brace 2219 or more than the four shown to secure gear dryer 2201. In alternative embodiments, a frame assembly such as frame assembly 2203 may be attached to base assemblies such as the above described base assemblies 127, 1517, 1617, and 1717.

Alternative gear dryer embodiments not shown may include multiple gear dryers connected in series or parallel by ducting, and may be ventilated by one or more blowers. The gear dryers may be separate assemblies with individual bases, or may be configured as separate ducting frame assemblies that share a common base. These embodiments may allow the creation of network of gear dryers, which may be useful in circumstances where large numbers of first responders are present and there is a large amount of protective equipment to dry and store. Other alternative embodiments not shown may include base and frame assemblies wherein the garment racks or gear racks are supported at lower ends rather than being suspended. For example, a gear dryer may have a ventilated base with gear dryers positioned along the base so that boots are dried on racks separate from gear on other gear racks such as helmets, masks, or gloves.

It is apparent that a system with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description and claims. Although the present embodiments are shown above, they are not limited to just these embodiments, but are amenable to various changes and modifications without departing from the spirit thereof.

The invention claimed is:

1. A system for drying personal protective equipment, comprising:

a base;

a blower for circulating air;

a frame carried by the base and conductively coupled to the blower, at least a portion of the frame forming a conduit through which air from the blower is forced through the frame; and at least one ventilated garment rack conductively coupled to the frame, such that air from the frame is forced through the garment rack, the garment rack comprising:

a valve for adjusting a flow of air from the frame into the garment rack;

a first pair of flexible ventilated tubes conductively coupled to the valve, the first pair of ventilated tubes being configured for insertion into sleeves of a coat of the personal protective equipment; a second pair of flexible ventilated tubes conductively coupled to the valve, the second pair of ventilated tubes being configured for insertion into an interior of the coat, but not into the sleeves of the coat; and a pair of generally rigid tubes conductively coupled to the valve, the pair of generally rigid tubes being configured for insertion into legs of pants of the personal protective equipment.

2. The system for drying personal protective equipment according to claim 1, wherein the blower is carried by the base.

3. The system for drying personal protective equipment according to claim 1, wherein the blower is remote from the base.

4. The system for drying personal protective equipment according to claim 1, further comprising:

a fluid collection system carried by the base.

5. The system for drying personal protective equipment according to claim 1, further comprising:

one or more casters coupled to the base, whereby the system for drying personal protective equipment may be rolled from one location to another.

6. The system for drying personal protective equipment according to claim 1, further comprising:

at least one ventilated gear rack conductively coupled to the frame, such that air from the frame is forced through the gear rack.

7. The system for drying personal protective equipment according to claim 6, wherein the at least one ventilated gear rack comprises:

a gear rack valve conductively coupled to the frame for adjusting the flow of air from the frame into the gear rack.

8. The system for drying personal protective equipment according to claim 7, wherein the at least one ventilated gear rack further comprises:

a multi-port coupling conductively coupled to the gear rack valve;

an upturned ventilated arm conductively coupled to each port of the multi-port coupling, each arm being configured to receive an item of gear of the personal protective equipment.

9. The system for drying personal protective equipment according to claim 1, further comprising:

a plurality of ventilated gear racks conductively coupled to the frame, such that air from the frame is forced through each gear rack;

wherein the gear racks are offset from each other about a vertical axis.

10. The system for drying personal protective equipment according to claim 1, further comprising ventilation ports arranged at least partially along a length of the first pair of flexible ventilated tubes, the second pair of flexible ventilated tubes, and the pair of generally rigid tubes.

11. The system for drying personal protective equipment according to claim 1, wherein the ventilation ports are all circular apertures.

12. The system for drying personal protective equipment according to claim 1, wherein some ventilation ports are all circular apertures and some of the ventilation ports are non-circular apertures.

13. The system for drying personal protective equipment according to claim 1, wherein the base comprises:

caps configured for supporting the frame on a floor.

14. The system for drying personal protective equipment according to claim 13, further comprising:

one or more braces coupled to the frame for coupling the frame to a structure.

15. The system for drying personal protective equipment according to claim 1, further comprising:

one or more of heating elements, filters, and substance dispersal implements operably associated with the blower.

16. A mobile system for drying personal protective equipment, comprising:

a base;

a blower for circulating air;

a frame carried by the base and conductively coupled to the blower, at least a portion of the frame forming a conduit through which air from the blower is forced through the frame; and at least one ventilated garment rack conductively coupled to the frame, such that air from the frame is forced through the garment rack, the garment rack comprising:

a valve for adjusting a flow of air from the frame into the garment rack;

a first pair of flexible ventilated tubes conductively coupled to the valve, the first pair of ventilated tubes being configured for insertion into sleeves of a coat of the personal protective equipment;

a second pair of flexible ventilated tubes conductively coupled to the valve, the second pair of ventilated tubes being configured for insertion into an interior of the coat, but not into the sleeves of the coat; and a pair of generally rigid tubes conductively coupled to the valve, the pair of generally rigid tubes being configured for insertion into legs of pants of the personal protective equipment;

one or more rough-terrain casters coupled to the base, whereby the system for drying personal protective equipment may be rolled from one location to another; and at least one handle coupled to the base.

17. The mobile system for drying personal protective equipment according to claim 16, further comprising:

a portable power supply coupled to the blower for supplying power to the blower.

18. The mobile system for drying personal protective equipment according to claim 16, further comprising:

a fluid collection system carried by the base.

19. The mobile system for drying personal protective equipment according to claim 16, further comprising:

a plurality of ventilated gear racks conductively coupled to the frame, such that air from the frame is forced through each gear rack;

wherein the gear racks are offset from each other about a vertical axis.

20. The mobile system for drying personal protective equipment according to claim 16, wherein the blower is remote from the base.

* * * * *